US005673443A

United States Patent [19]

Marmor

[11] Patent Number: 5,673,443

[45] Date of Patent: Oct. 7, 1997

[54] APPARATUS FOR TURNING A PATIENT IN BED

[76] Inventor: Maxine S. Marmor, 4611 Bridle Trail, Santa Rosa, Calif. 95409

[21] Appl. No.: 706,127

[22] Filed: Aug. 30, 1996

[51] Int. Cl.[6] ..... A61G 7/10

[52] U.S. Cl. ..... 5/88.1; 5/89.1; 5/85.1

[58] Field of Search ..... 5/609, 81.1 R, 5/83.1, 84.1, 85.1, 87.1, 88.1, 89.1, 81.1 T

[56] References Cited

U.S. PATENT DOCUMENTS

| | | | |
|---|---|---|---|
| 595,741 | 9/1897 | Shutters | 5/88.1 |
| 1,301,284 | 4/1919 | Ledan | 5/84.1 |
| 2,603,851 | 7/1952 | Hawkins | 5/85.1 X |
| 4,397,051 | 8/1983 | Wheeler | 5/84.1 |
| 5,161,267 | 11/1992 | Smith | 5/88.1 X |
| 5,544,371 | 8/1996 | Fuller | 5/88.1 X |

*Primary Examiner*—Michael F. Trettel
*Attorney, Agent, or Firm*—Larry D. Johnson

[57] ABSTRACT

An apparatus for periodically turning a patient from side to side in a bed includes a pull sheet portion having first and second lateral edges, with a plurality of first straps connected to the first edge, and a plurality of second straps connected to the second edge. These first and second straps each extend upwards to complementary strap spools supported on a longitudinal shaft over the patient and bed. A motor is adapted to rotate these strap spools in a selected direction to coil and retract one set of the straps, while uncoiling and extending the other set, so as to selectively raise one of the edges of the pull sheet while lowering the other, effectively turning the patient to one side or the other on the bed. A frame portion supports the longitudinal shaft, and an operator control box regulates and controls the motor.

10 Claims, 3 Drawing Sheets

APPARATUS FOR TURNING A PATIENT IN BED

BACKGROUND OF THE INVENTION

1. Field of the Invention

This invention relates generally to hospital and home invalid care equipment, and more specifically to an improved apparatus for periodically turning a bedridden patient from side to side in a bed.

2. Description of the Prior Art

Many individuals are temporarily or permanently confined to a bed. In such cases, it is often desirable or even necessary for the patient to periodically turn from side to side in the bed, so as to avoid bedsores, infections and other medical complications. However, in those circumstances where the patient is physically unable to turn himself or herself, this may require the ongoing attention of one or more caregivers to manually turn the patient. This can be a labor-intensive, cumbersome and expensive process.

SUMMARY OF THE INVENTION

The present invention provides an improved apparatus for periodically turning a bedridden patient from side to side in a bed. The inventive apparatus includes a pull sheet portion including first and second lateral edges, with a plurality of first line or strap elements connected to the pull sheet first lateral edge, and a plurality of second line or strap elements connected to the second lateral edge. These first and second strap elements each extend upwards to complementary strap spools supported on a longitudinal shaft over the patient and bed. A motor portion is adapted to rotate these strap spools in a selected direction to coil and retract one set of the first or second strap elements, while uncoiling and extending the other set, so as to selectively raise one of the first or second lateral edges of the pull sheet while lowering the other, effectively turning the patient to one side or the other on the bed. A frame portion supports the longitudinal shaft and, if appropriate, the motor. An operator control box regulates and controls the motor, and is preferably suspended near the patient for ease of access.

BRIEF DESCRIPTION OF THE DRAWINGS

FIG. 3 illustrates the patient fully turned onto their left side;

FIG. 4 illustrates the patient flat on their back on the bed; and

FIG. 5 illustrates the patient fully turned onto their right side.

DETAILED DESCRIPTION OF A PREFERRED EMBODIMENT

Figure 1:
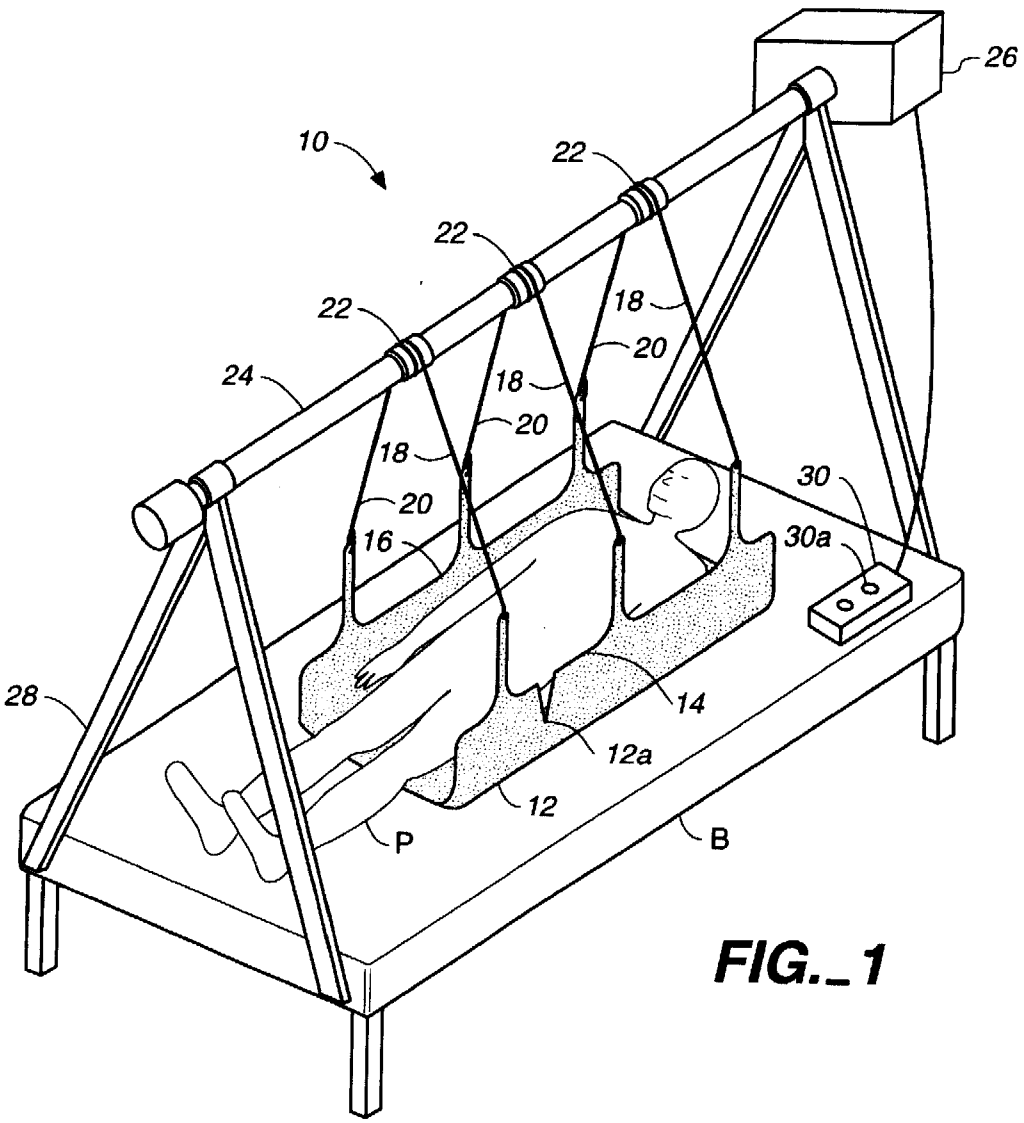
FIG. 1 is a perspective pictorial view of an apparatus of this invention for turning a patient in a bed, illustrating a patient reclined in a typical bed or mattress and upon a pull sheet.

FIG. 1 is a perspective pictorial view of the apparatus 10 of this invention for turning a patient in a bed, illustrating the patient P reclined in the typical bed or mattress B upon a pull or draw sheet portion 12 including first and second lateral edges 14, 16. The pull sheet portion 12 is preferably made of strong, flexible material, and of a size to support a patient's head, trunk and legs. The pull sheet may include gaps or other apertures 12*a* for passage of catheters, monitor lines, and the like. A plurality (e.g., three) of first line or strap elements 18 is connected to the pull sheet first lateral edge 14, and a plurality (e.g., three) of second line or strap elements 20 is connected to the pull sheet second lateral edge 16. These first and second strap elements are preferably made of non-stretching filament, web or belt material such as nylon.

These strap elements extend upwards to complementary strap spools 22 supported on a longitudinal shaft 24 over the patient and bed. A motor 26 such as a geared electric motor is adapted to rotate the strap spools 22 (either by rotating the entire longitudinal shaft, or just the spools relative to a stationary shaft) in a selected direction to coil and retract one set of either the first or second strap elements, and uncoil and extend the other set of strap elements, to selectively raise one of the first or second lateral edges 14, 16 of the pull sheet 12 while lowering the other. Thus, the patient resting on the pull sheet is gently turned to one side or the other, and maintained in that new position by the pull sheet.

A frame portion 28 supports the longitudinal shaft 24 and motor 26. Alternatively, the motor could be housed in another location and connected to drive the longitudinal shaft by belts, pulleys, or other means. An operator control box 30 regulates and controls the motor, preferably within adjustable travel limits to prevent over-rotation of the strap spools (and thus the patient). The control box may utilize a single switch, such as a double pole, double throw, center off momentary switch. The motor is preferably geared or otherwise self-braking, enabling the operator to selectively turn the patient to any position within the approximately 180 degrees of rotation preferably provided by the apparatus, and maintain the patient in that selected position for any desired length of time.

The control box 30 may include a programmable timer mechanism 30*a* to enable chronologically selective timing of motor activation, and thus patient turning. Such an application may reduce or even eliminate the need for an assistant for the patient. In an alternate embodiment, the control box could be operated from a remote location (e.g., a nurse's station).

Figure 2:
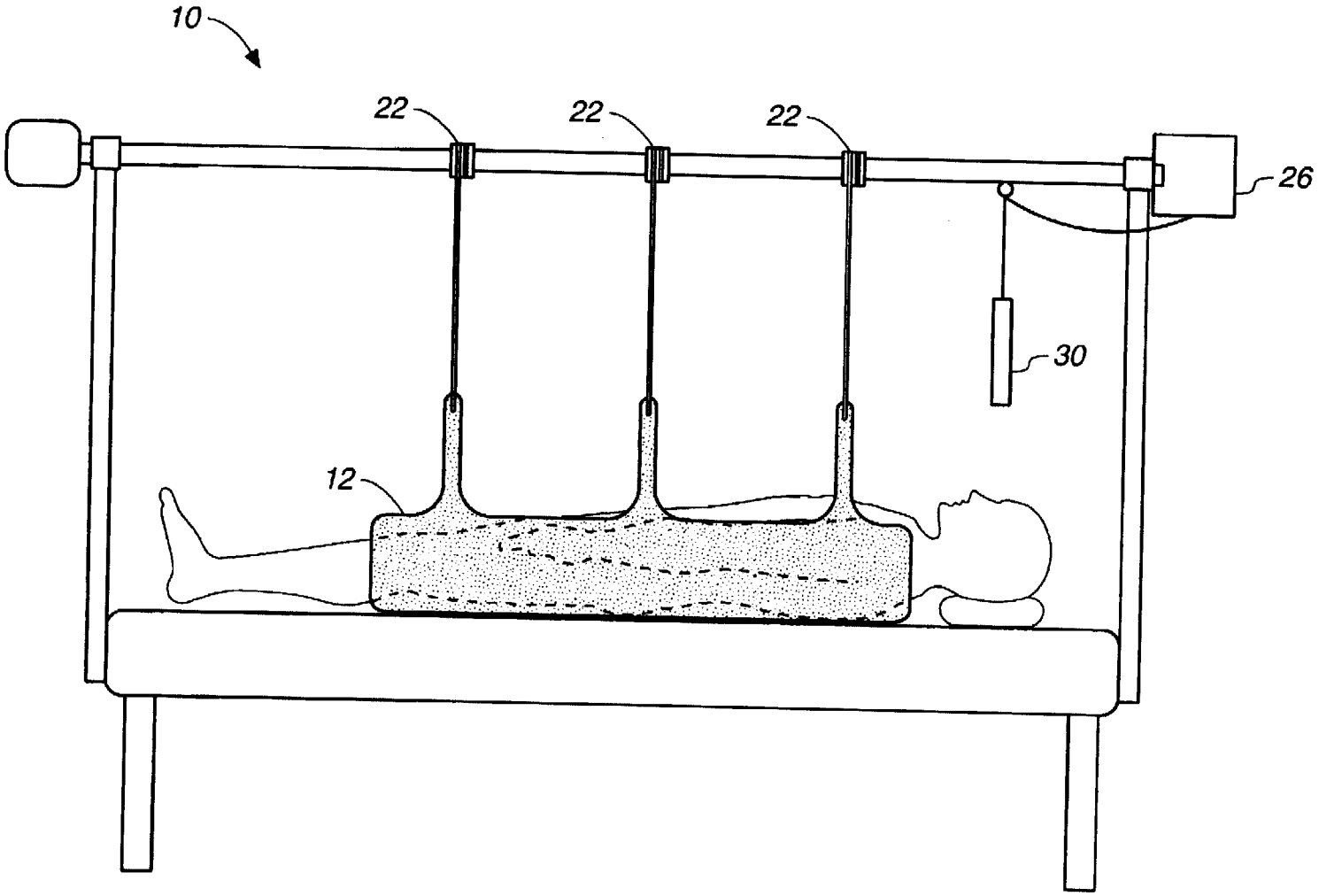
FIG. 2 is a side elevation pictorial view of the apparatus of this invention.

FIG. 2 is a side elevation pictorial view of the apparatus 10 of this invention for turning a patient in bed, illustrating the operator control box 30 suspended over the patient's head for ease in access by the patient. In this manner, many patients may manipulate the control box themselves, obviating the need for constant attention by an outside caregiver.

Figure 5:
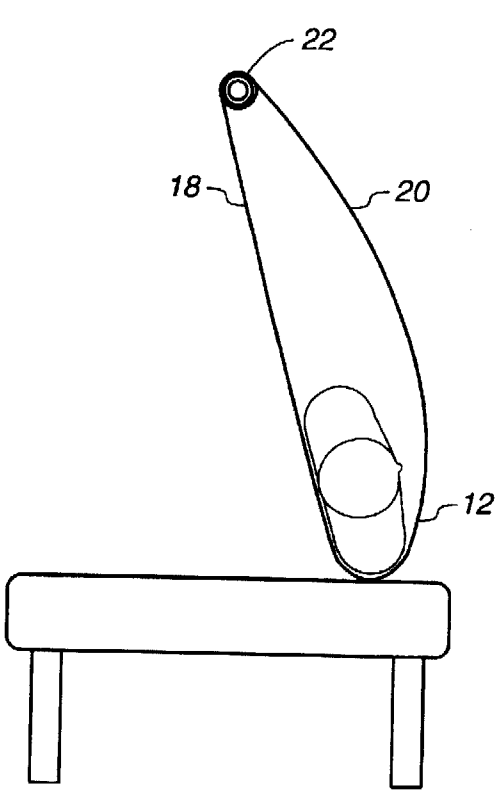
FIGS. 3–5 are a series of end elevation schematic views of the patient being turned by the apparatus of this invention.
Figure 4:
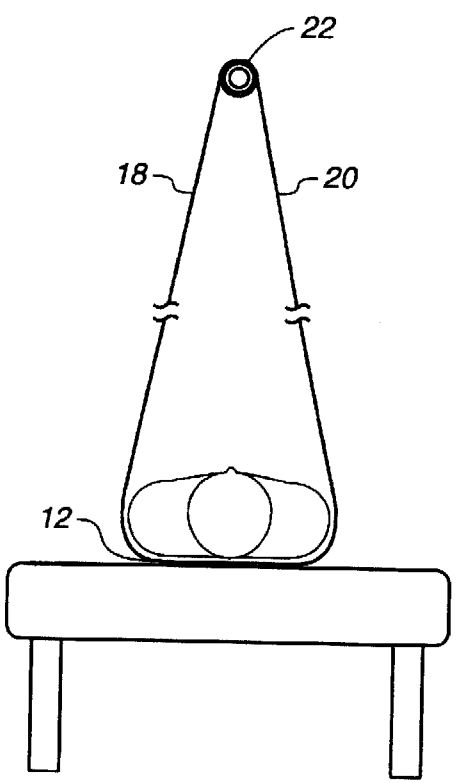
Figure 3:
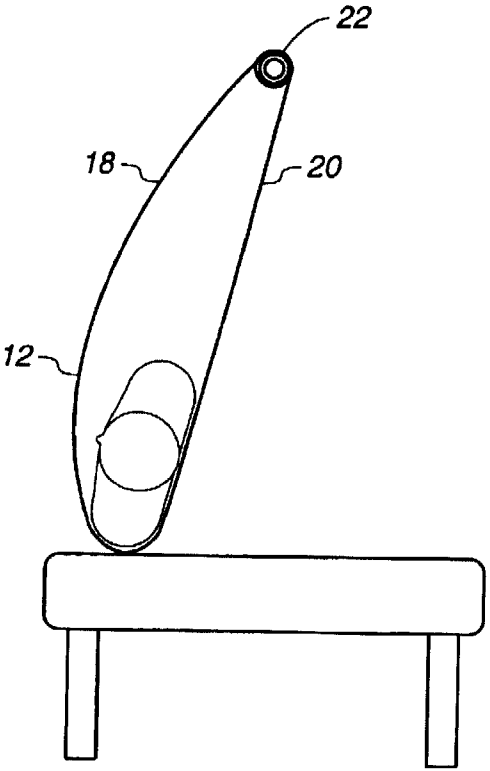

FIGS. 3–5 are a series of end elevation schematic views of a patient being turned by the apparatus of this invention, illustrating the relative movement of the strap spool(s) 22, strap elements 18, 20, and pull sheet 12 to turn the patient a total of approximately 180 degrees relative to the bed B. FIG. 3 illustrates the patient having been fully turned onto their left side (near the right side of the bed). FIG. 4 illustrates the patient flat on their back on the bed (proximate the middle of the bed). FIG. 5 illustrates the patient having been fully turned onto their right side (near the left side of the bed). As described, any of these positions can be maintained by the apparatus, for any desired period of time.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and equivalents.

What is claimed as invention is:

1. An apparatus for periodically turning a bedridden patient from side to side in a bed, said apparatus comprising:

a pull sheet portion including first and second lateral edges;

a plurality of first strap elements connected to said pull sheet first lateral edge, and a plurality of second strap elements connected to said pull sheet second lateral edge, said first and second strap elements each extending upwards to complementary strap spools supported on a longitudinal shaft over the patient and bed;

a motor portion adapted to rotate said strap spools in a selected direction to coil and retract one set of said first or second strap elements, while uncoiling and extending the other set of said first or second strap elements, so as to selectively raise one of said first or second lateral edges of said pull sheet while lowering the other of said first or second lateral edges of said pull sheet, effectively turning the patient to one side or the other on the bed.

2. The apparatus for periodically turning a bedridden patient from side to side in a bed of claim 1 further including a frame portion to support said longitudinal shaft.

3. The apparatus for periodically turning a bedridden patient from side to side in a bed of claim 1 further including an operator control box to regulate said motor.

4. The apparatus for periodically turning a bedridden patient from side to side in a bed of claim 3 wherein said operator control box to regulate said motor comprises a single momentary switch.

5. The apparatus for periodically turning a bedridden patient from side to side in a bed of claim 1 wherein said strap elements comprise non-stretching web material.

6. The apparatus for periodically turning a bedridden patient from side to side in a bed of claim 1 wherein said apparatus includes three first strap elements connected to said pull sheet first lateral edge, and three second strap elements connected to said pull sheet second lateral edge.

7. The apparatus for periodically turning a bedridden patient from side to side in a bed of claim 1 wherein said motor comprises a geared electric motor.

8. The apparatus for periodically turning a bedridden patient from side to side in a bed of claim 1 wherein said motor is adapted to selectively turn the patient to any position within approximately 180 degrees of rotation, and maintain the patient in that selected position for any desired length of time.

9. The apparatus for periodically turning a bedridden patient from side to side in a bed of claim 1 wherein said pull sheet includes at least one opening for passage of a catheter.

10. The apparatus for periodically turning a bedridden patient from side to side in a bed of claim 1 including a timer mechanism adapted to selectively activate said motor portion.

* * * * *